United States Patent [19]

Clark

[11] 4,179,755

[45] Dec. 25, 1979

[54] BELT WITHOUT BUCKLE

[75] Inventor: Edward J. Clark, Newhall, Calif.

[73] Assignee: Tandy Brands, Inc., Fort Worth, Tex.

[21] Appl. No.: 910,200

[22] Filed: May 30, 1978

[51] Int. Cl.[2] ..... A41F 9/00

[52] U.S. Cl. ..... 2/322

[58] Field of Search ..... 2/321, 322, 309, 310, 2/311; 24/222, 206

[56] References Cited

U.S. PATENT DOCUMENTS

| | | | |
|---|---|---|---|
| 596,849 | 1/1898 | Combier | 2/321 |
| 661,689 | 11/1900 | Clow | 24/222 |
| 1,428,358 | 9/1922 | Burbery | 24/222 |
| 1,854,125 | 4/1932 | Faber | 24/222 |
| 2,446,018 | 7/1948 | Miskimen | 2/321 |

FOREIGN PATENT DOCUMENTS

| | | | |
|---|---|---|---|
| 126021 | 4/1900 | Fed. Rep. of Germany | 2/321 |
| 564375 | 9/1944 | United Kingdom | 24/206 |

*Primary Examiner*—Ronald Feldbaum
*Attorney, Agent, or Firm*—Robert A. Felsman

[57] ABSTRACT

Disclosed herein is a belt that uses a fastening device other than a buckle. The belt is of the type having inner and outer plies of leather. Pins having enlarged heads are fastened to one of the plies at one end of the belt. Apertures to receive the pins are placed in the other ply at the other end of the belt. A metal plate is spaced between the plies. It has apertures that are enlarged on one end and are reduced on the other end to receive and lock pins. The pins can be removed from the apertures by pressing the overlapping ends together.

5 Claims, 3 Drawing Figures

Fig. 3
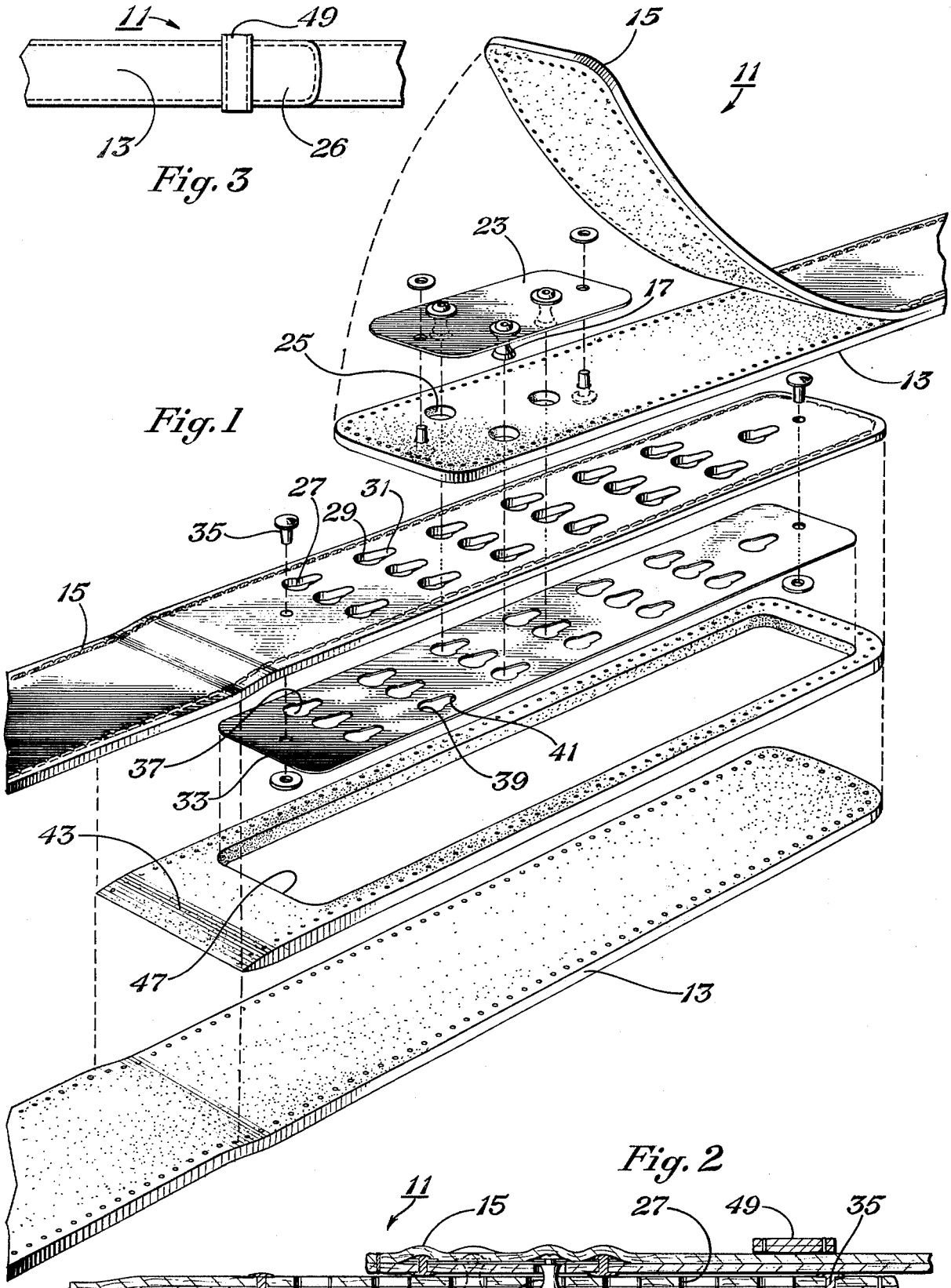
Fig. 1
Fig. 2
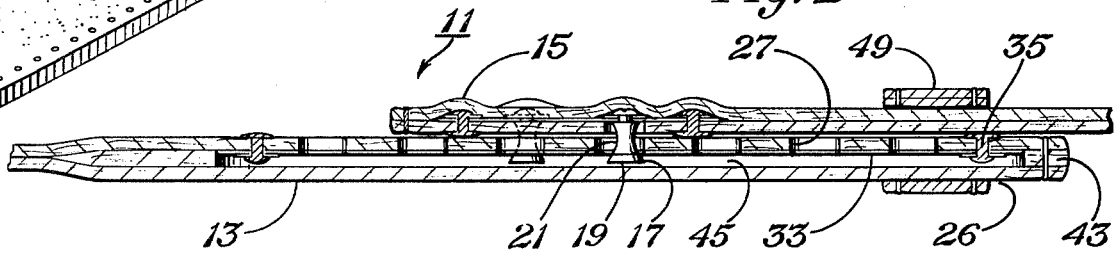

BELT WITHOUT BUCKLE

BACKGROUND OF THE INVENTION

1. Field of the Invention

This invention relates in general to trouser belts, and in particular to a trouser belt that has a fastening device other than a buckle.

2. Description of the Prior Art

Police officers normally wear heavy, wide belts for carrying their holster, ammunition, handcuffs and the like. These belts usually are fastened together by conventional metal buckles. Assailants may use the shiny buckle as a target, thus it is desirable to eliminate the buckle.

One belt uses overlapping ends with strips of "Velcro" adhesive material to restrain them together. One disadvantage of this type is that in a struggle, the "Velcro" strips may be pulled apart, unless it had additional retaining devices. The loose belt would enhance the chances for an assailant to take the officer's revolver.

More positive type fasteners are known, such as the pin and slot arrangement shown in the waistband of U.S. Pat. No. 596,849. The pins, however, are visible on the exterior of the belt, which is not desirable for appearance and safety.

SUMMARY OF THE INVENTION

It is a general object of this invention to provide an improved fastening means for a belt that does not utilize a buckle and provides a smooth exterior appearance.

It is a further object of this invention to provide an improved belt fastening means that does not use a buckle and cannot be unfastened by pulling outward on the overlapping end.

In accordance with these objects a belt fastening means is provided that utilized pins having enlarged heads for locking in elongated slots or apertures. The pins protrude outward from the belt at one end, while the apertures are located on the opposite end and face the pins when the belt is placed in a looped position. The restraining means for retaining the pins is a metal plate having apertures that align with the apertures in the belt. The apertures in the plate have enlarged portions for receiving the head and adjoining reduced portions that will receive the necks of the pins, but not the heads. The exterior of the belt in the overlapped portion is free of apertures to provide a smooth appearance.

BRIEF DESCRIPTION OF THE DRAWINGS

FIG. 1 is an exploded perspective view of the ends of the belt constructed in accordance with this invention.

FIG. 2 is a cross-sectional view of the ends of the belt of FIG. 1 in an assembled position.

FIG. 3 is a front elevational view of the ends of the belt of FIG. 1.

DESCRIPTION OF THE PREFERRED EMBODIMENT

Referring to FIG. 1, the belt 11 has an outer ply 13 and an inner ply 15, both of leather and stitched together. The exposed side of the inner ply 15 is in contact with the wearer, and the exposed side of the outer ply 13 faces outward from the wearer.

Three metal pins 17 are fastened to the belt 11 in a triangular pattern near one end. Pins 17 protrude outward from the wearer, and have enlarged heads 19, and reduced neck portions 21, as shown also in FIG. 2. The head 19 has a larger diameter, or cross-sectional dimension, than neck 21. The transition between the head 19 and neck 21 is gradual and tapered, with the base being flared to provide a strong stable connection. Pins 17 are rigidly fastened to a metal plate 23 that is riveted to the inside surface of outer ply 13. pins 17 protrude through holes 25 in the outer ply 13.

The other end, or overlapping end 26, of belt 11 has a plurality of apertures 27 in the inner ply 15 for receiving the three pins 17. The apertures 27 are spaced in rows of three at selected distances for size adjustment. The apertures 27 are elongated, having a larger circular portion 29 and an adjoining circular portion 31 of smaller diameter than portion 29. The smaller portion 31 is on the side of the apertures that is nearest to the termination of overlapping end 26.

A metal plate 33 is fixed to the inside wall of the inner ply 15 by rivets 35. Plate 33 has a plurality of apertures 37 that align with apertures 27 in the inner ply 15. Apertures 37 also have an enlarged circular portion 39 and a smaller circular portion 41, which is on the side of the apertures 37 nearest the termination of overlapping end 26. The diameter of the enlarged portion 39 is sufficient to receive the heads 19 of pins 17. The diameter of the smaller portion 41 is sufficient to receive the necks 21 of pin 17, but not the heads.

A spacer 43 is interposed between the inner and outer plies at the apertures 27 for providing a clearance 45 (FIG. 2), for receiving the heads 19 of pins 17. Spacer 43 is a rectangular piece of leather having a large rectangular opening 47 of dimensions approximately equal to the plate 33. As shown in FIG. 3, a loop 49 of leather is provided to restrain the end of the overlapped portion 26 when fastened.

In use, the officer places the belt around himself, aligns pins 17 with three of the apertures 27, and presses inwardly to force the heads 19 through the enlarged portions 39. Once the inner ply 15 is in contact with the outer ply 13, as shown in FIG. 2, the officer then pulls the ends of the belt in the opposite directions. This draws the neck 21 of each pin 17 into the smaller portion 41 of aperture 37. Because heads 19 are larger than the diameter of the smaller portions 41, the pins cannot be removed by pulling outward on overlapping end 26 while in this position. Belt loop 49 is then slid over the overlapping portions of the belt.

As shown in FIG. 3, the outer ply 13 of belt is smooth and free of apertures to provide a pleasing appearance. To remove the belt, the ends are pressed together, sliding pins 17 into the larger portion 39 of apertures 37. Then overlapping end 26 is pulled outward, removing the pins 17 from the apertures 27 and 37. The necked pins and slotted apertures thus serve as restraining means for restraining the pins in the apertures.

It should be apparent that an invention having significant advantages has been provided. The new fastening means provides a belt without a buckle and with a smooth exterior appearance. The fastening means is strong and cannot be pulled apart by pulling on the overlapped end.

While the invention has been shown in only one of its forms, it should be apparent to those skilled in the art that it is not so limited but is susceptible to various changes and modifications without departing from the spirit thereof.

I claim:

1. An apparel belt having inner and outer plies with improved fastening means for fastening the belt, comprising:

a plurality of pins protruding outward from the outer ply adjacent one end of the belt, each pin having a head and a neck of diameter less than the head;

the inner ply at the other end of the belt having a plurality of apertures positioned so as to mate with the pins to fasten the belt, the apertures being of a size sufficient for receiving the pins;

a metal plate fastened to the inside wall of the inner ply and having a plurality of apertures aligned with the apertures of the inner ply, each aperture of the plate having an enlarged portion of diameter sufficient to receive the head of one of the pins, and an adjoining reduced portion of a diameter sufficient to receive the neck of one of the pins, but not the head, for retaining the pins in the apertures while in the reduced portion, the area of the outer ply adjacent the apertures in the plate being free of apertures to provide a smooth exterior; and a spacer interposed between the inner and outer plies at the apertures to provide a clearance between the plate and the inside wall of the outer ply for the heads of the pins.

2. The apparatus according to claim 1 wherein the reduced portion for each aperture is on the side nearest to the overlapping end, so that the pins are drawn into the reduced portions by pulling the ends of the belt in opposite directions.

3. The apparatus according to claim 1 wherein the pins are secured to a metal plate fastened to the inside wall of the outer ply.

4. An apparel belt having two plies with improved means for fastening the belt, comprising:

a plurality of pins extending from a first plate that is disposed between the plies at a first end of the belt, the pins protruding through one of the plies, each pin having a head and a neck of lesser diameter than the head;

a second plate disposed between the plies at a second end of the belt, the second plate and one of the plies having a plurality of apertures that register with each other and are positioned to receive the pins when the first and second ends are overlapped, each aperture of the second plate having an enlarged portion of diameter sufficient to receive the head of one of the pins, and an adjoining reduced portion of diameter sufficient to receive the neck of one of the pins, but not the head, for retaining the pins in the aperture while in the reduced portion; the second plate being mounted in contact with the ply that contains the apertures; and a spacer member disposed between the plies at the second end and surrounding the apertures in the second plate, the spacer member being of a thickness sufficient to provide a space between the plies to accomodate the heads of the pins.

5. The belt according to claim 4 wherein the apertures for receiving the pins are located in only one of the plies.

* * * * *